US005944201A

United States Patent [19]

Babboni et al.

[11] Patent Number: 5,944,201

[45] Date of Patent: Aug. 31, 1999

[54] CONTROL MOVEMENT RACKING SYSTEM

[75] Inventors: Charles Joseph Babboni, New York, N.Y.; David Andrew Dalton, Cincinnati, Ohio; Eric Francis Henry, Rutherford; Tatsuo Rushing, Ringwood, both of N.J.

[73] Assignee: The Proctor & Gamble Company, Cincinnati, Ohio

[21] Appl. No.: 08/939,638

[22] Filed: Sep. 29, 1997

[51] Int. Cl.[6] ..... A47F 5/00

[52] U.S. Cl. ..... 211/151; 211/71.01; 312/323

[58] Field of Search ..... 211/29, 151, 170, 211/126.15, 162, 59.2; 312/323, 322, 350; 248/292.14

[56] References Cited

U.S. PATENT DOCUMENTS

| | | | |
|---|---|---|---|
| 1,628,846 | 5/1927 | Karst . | |
| 1,804,597 | 5/1931 | Donaldson et al. | 312/323 |
| 2,238,004 | 4/1941 | Wolters | 312/323 |
| 2,466,033 | 4/1949 | Martin | 45/7 |
| 2,908,397 | 10/1959 | Patterson | 211/93 |
| 3,018,003 | 1/1962 | Lockwood | 211/126 |
| 3,125,225 | 3/1964 | Brengman et al. | 211/126 |
| 3,133,768 | 5/1964 | Klakovich | 312/323 X |
| 3,199,683 | 8/1965 | Graswich | 211/71 |
| 3,355,134 | 11/1967 | Chesley | 248/250 |
| 3,356,432 | 12/1967 | Stroud et al. | 312/323 |
| 3,894,634 | 7/1975 | Gotham et al. | 211/150 |
| 3,908,831 | 9/1975 | Brendgord | 211/88 |
| 3,953,044 | 4/1976 | Wilson | 280/33.99 H |
| 3,993,002 | 11/1976 | Stroh | 108/108 |
| 4,250,815 | 2/1981 | Swanson | 108/108 |
| 4,289,242 | 9/1981 | Kenyon | 211/4 |
| 4,343,244 | 8/1982 | Moriarty et al. | 108/1 |
| 4,456,125 | 6/1984 | Chap | 206/513 |
| 4,516,682 | 5/1985 | Bell | 211/59.1 |
| 4,531,646 | 7/1985 | Howard | 211/150 |
| 4,705,175 | 11/1987 | Howard et al. | 211/59.2 |
| 4,771,898 | 9/1988 | Howard et al. | 211/59.2 |
| 4,785,944 | 11/1988 | March | 211/59.2 |
| 4,923,070 | 5/1990 | Jackle et al. | 211/59.2 |
| 4,923,259 | 5/1990 | Bartok | 312/323 X |
| 4,991,722 | 2/1991 | Hight | 211/59.1 |
| 5,065,920 | 11/1991 | Amner | 312/323 X |
| 5,092,484 | 3/1992 | Daugherty et al. | 220/331 |
| 5,169,221 | 12/1992 | Wheeler | 312/323 |
| 5,197,610 | 3/1993 | Bustos | 211/59.2 |
| 5,215,364 | 6/1993 | Moore | 312/323 |
| 5,415,300 | 5/1995 | Krummell et al. | 211/151 |
| 5,553,723 | 9/1996 | Stein | 211/71.01 X |
| 5,571,256 | 11/1996 | Good et al. | 211/151 X |
| 5,617,961 | 4/1997 | Konstant et al. | 211/151 |
| 5,638,965 | 6/1997 | Mattingly et al. | 211/151 |

FOREIGN PATENT DOCUMENTS

| | | |
|---|---|---|
| 2591201 A1 | 6/1987 | France . |
| 4012909 A1 | 10/1991 | Germany . |
| 1004205 | 3/1983 | U.S.S.R. . |
| 1211160 | 2/1986 | U.S.S.R. . |
| 1576435 A1 | 7/1990 | U.S.S.R. . |

*Primary Examiner*—Robert W. Gibson, Jr.

*Attorney, Agent, or Firm*—James C. Vago; Rodney M. Young

[57] ABSTRACT

A racking system exhibiting controlled compound movement is disclosed. The racking system includes a bracket adapted for engagement to a structural support and a translational tray assembly supported by the bracket for linear and rotational movement relative to the bracket. The system also includes a first dampening member associated with the translational tray assembly for dampening the linear movement of the translational tray assembly relative to the bracket and a second dampening member associated with the translational tray assembly for dampening the rotational movement of the translational tray assembly relative to the bracket. The first and second dampening members ensure smooth, controlled motion as the translational tray assembly is rotationally and linearly moved.

20 Claims, 5 Drawing Sheets

FIG. 1
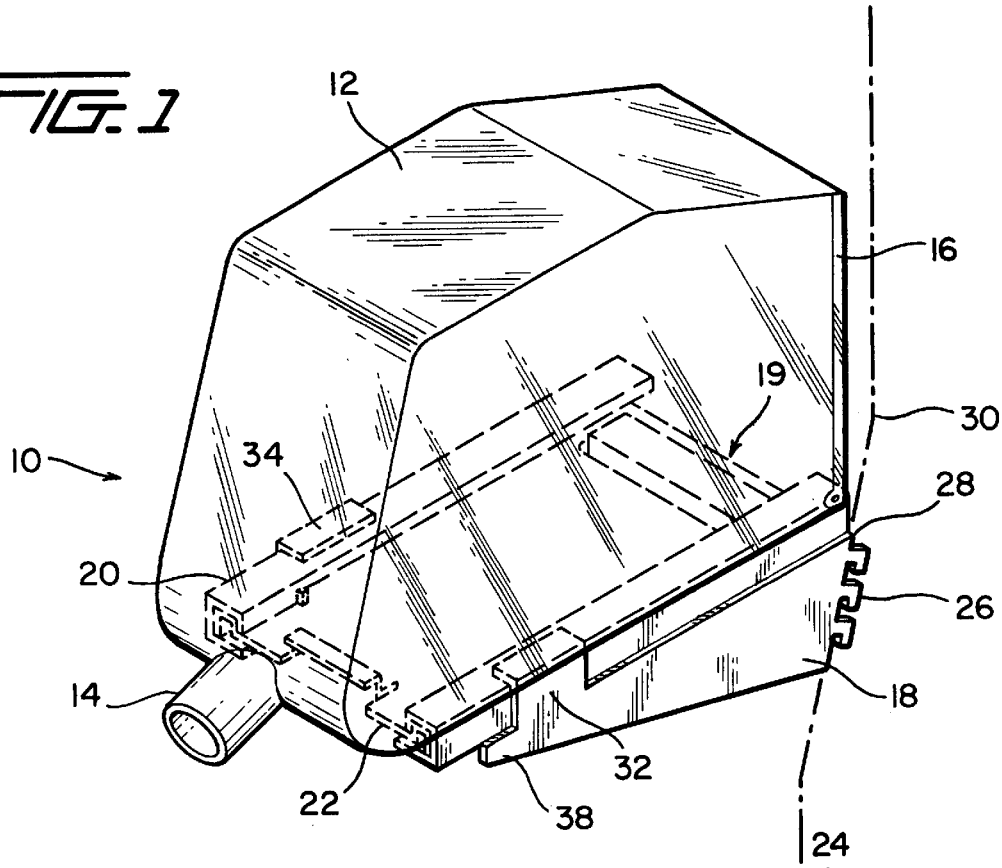
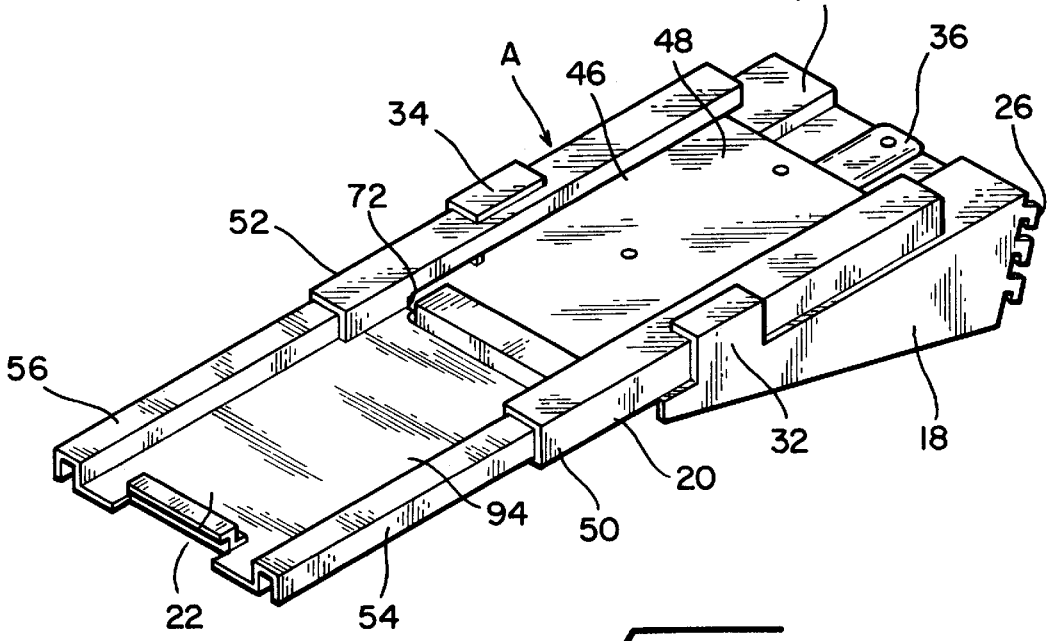
FIG. 2

CONTROL MOVEMENT RACKING SYSTEM

FIELD OF THE INVENTION

The invention relates to an adjustable racking system. More particularly, the invention relates to an adjustable racking system with linear and pivotal movement.

BACKGROUND OF THE INVENTION

Racking systems for supporting, displaying and dispensing various articles come in a variety of sizes, shapes and designs useful for performing different functions. In most instances, these racking systems have a multitude of separate compartments or containers dividing various items.

In everyday use, these racking systems are often seen in institutions, such as libraries for storing periodicals and miscellaneous papers, or in food stores for dispensing bulk fungible items, such as candies, nuts and coffee. Further, these racking systems can comprise a system for individually dispensing the desired items contained therein. This arrangement is very advantageous as it allows for a consumer to select and receive a variety of commercial products without the need for direct human assistance.

To be of beneficial use, these racking systems need to be easily and readily accessible to the persons that are both using and servicing them. Specifically, the person who changes, cleans, refills or replaces the variety of contents stored within the racking system must be provided with easy access to the racking system and the various compartments or containers held by the racking system.

Though there are many existing racking systems, most of these racking systems are designed to reduce friction between the various moving parts so that the least amount of effort is required to utilize the system. Further, these systems are designed to be easily accessible and readily accommodate the end user while often failing to provide consideration for those persons that must restock or change the items accommodated by the racking system.

Specifically, a consumer that uses the racking system to obtain a portion of the contents contained within a compartment can readily select an exact amount that he or she is interested in receiving. However, these compartments are often fairly large and they are typically not refilled a single scoop at a time. Rather, they are refilled at a quicker rate by emptying a large container into the compartment. This is usually done by opening the rack up and removing or adjusting an inlet portion of the compartment so that the compartment can be refilled.

One problem with currently available racking systems is that they fail to account for the size and weight of the compartment or items contained therein during servicing. This is inconvenient and can sometimes be dangerous to the refiller, who is not provided convenient access to the compartment inlet.

Further, though there are hinged racks, these are typically limited to fixed length racks which extend out from the racking system and which pivot at the point of contact between the rack and the racking system. This leads to excess strain on the racks as they are extended, because the refiller is required to support the weight of the rack as it is being utilized. Since this might be difficult depending upon the size and strength of the refiller, such racks can be opened in an uncontrolled manner. This creates excess wear and tear on the system which reduces the life expectancy of the racking system and can cause additional safety concerns for the user.

A need, therefore, exists for a racking system which securely supports desired items, while also providing ready access for refilling of the storage compartments supported by the racking system.

SUMMARY OF THE INVENTION

It is, therefore, an object of the present invention to provide a racking system exhibiting controlled compound movement. The racking system includes a bracket adapted for engagement to a structural support and a translational tray assembly supported by the bracket for linear and rotational movement relative to the bracket. The system also includes a first dampening member associated with the translational tray assembly for dampening the linear movement of the translational tray assembly relative to the bracket and a second dampening member associated with the translational tray assembly for dampening the rotational movement of the translational tray assembly relative to the bracket. The first and second dampening members ensure smooth, controlled motion as the translational tray assembly is rotationally and linearly moved.

It is also an object of the present invention to provide a racking system wherein the translational tray assembly includes a first translational tray telescopically connected to a second translational tray. A third dampening member between the second translational tray and the first translational tray can be provided for dampening the linear movement of the second translational tray relative to the bracket and the first translational tray.

It is also an object of the present invention to provide a racking system including a bracket adapted for engagement to a structural support, an upper translational tray supported by the bracket for linear and rotational movement relative to the bracket, and a mounting bracket securely coupling the upper translational tray to the bracket in a manner permitting linear and rotational movement of the upper translational tray. The upper translational tray is pivotally coupled to the mounting bracket and a rotational dampening member is positioned between the upper translational tray and the mounting bracket to ensure smooth, controlled motion as the upper translational tray is rotated between a first position and a second position.

It is another object of the present invention to provide a racking system including a central translational tray positioned between the upper translational tray and the bracket, wherein the mounting bracket is coupled between the upper translational tray and the central translational tray.

It is a further object of the present invention to provide a racking system exhibiting controlled linear movement. The racking system includes a bracket adapted for engagement to a structural support, a first translational tray supported by the bracket for linear movement relative to the bracket, and a second translational tray supported by the first translational tray for linear movement relative thereto. In addition, a first dampening member is provided between the bracket and the first translational tray for dampening the linear movement of the first translational tray relative to the bracket and a second dampening member is provided between the second translational tray and the first translational tray for dampening the linear movement of the second tray relative to the first translational tray. The first dampening member and the second dampening member ensuring smooth, controlled motion as the first and second translational trays are moved.

It is also an object of the present invention to provide a racking system wherein the second dampening member is a dampening sleeve coupled to the runner of the second translational tray. The dampening sleeve is shaped and dimensioned to frictionally engage an inner wall of the guiding channel.

It is another object of the present invention to provide a racking system wherein the first dampening member is a magnet.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view of the present racking system;

FIG. 2 is a perspective view of the present racking system with the first and second translational trays partially extended;

DETAILED DESCRIPTION OF THE INVENTION

Figure 3:
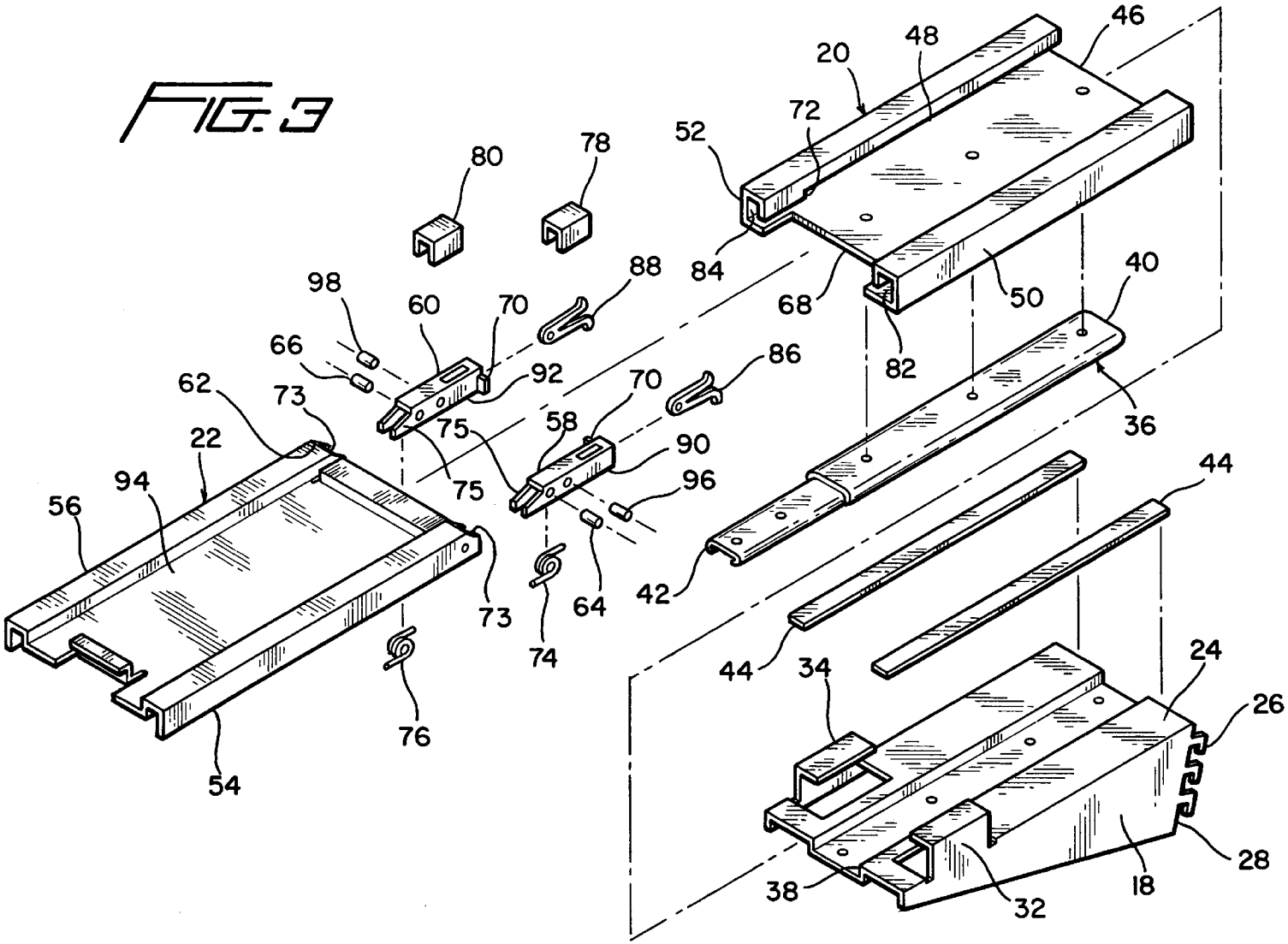
FIG. 3 is an exploded view of the present racking system.
Figure 4:
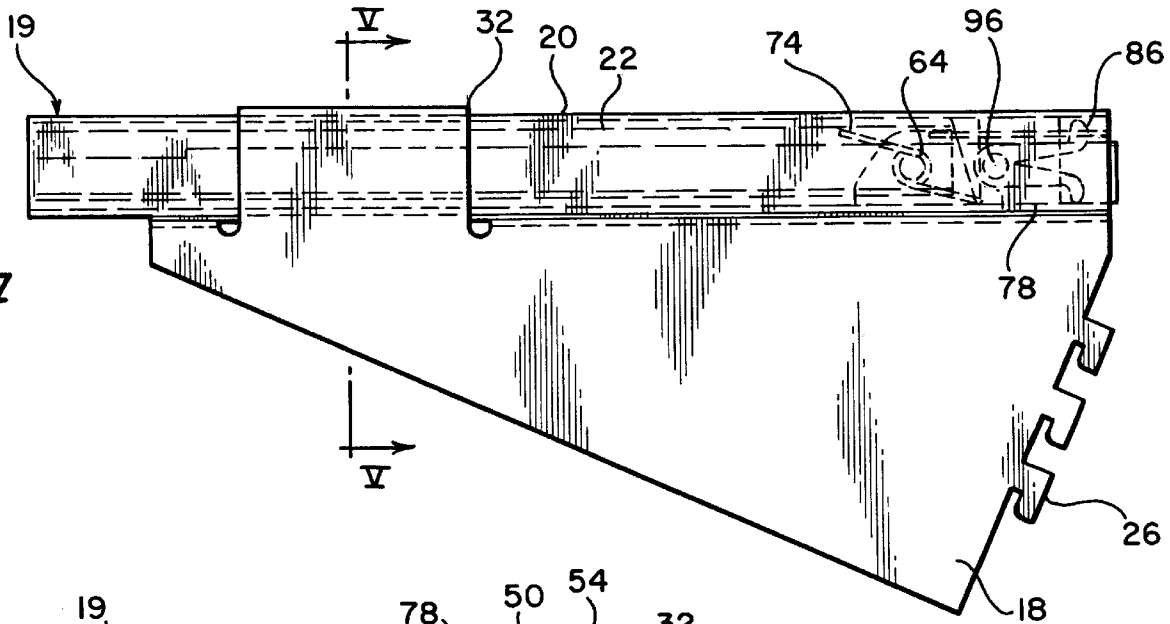
FIG. 4 is a side view of the present racking system with the structure within the guiding channel shown in phantom.
Figure 5:
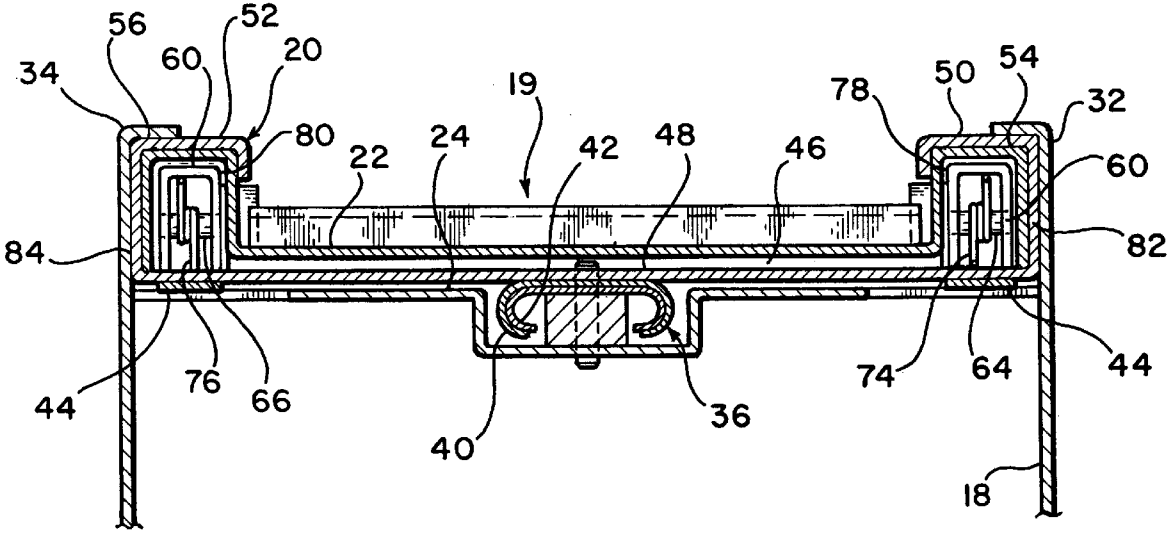
FIG. 5 is a cross sectional view taken along the line V—V in FIG. 4.

With reference to FIG. 1, the present racking system 10 is disclosed. The racking system 10 provides a support upon which a container 12 can be positioned to simplify access to the container 12. As those of ordinary skill in the art will certainly appreciate, containers commonly employed to display and dispense items generally include a dispensing outlet 14 and a filling inlet 16. In most instances it is desirable to conceal the filling inlet 16 until such a time that the container 12 must be refilled. At that time, the filling inlet 16 is accessed and the container 12 is filled with the desired item. The present racking system 10 supports such a container 12 in a manner permitting easy access to the filling inlet 16 of the container 12. While the present racking system 10 is described for use in supporting containers, the racking system can be employed for a wide variety of purposes without departing from the spirit of the present invention.

With reference to the various figures, the racking system 10 is composed of a bracket 18 supporting a translational tray assembly 19 for movement relative to the bracket 18. The translational tray assembly includes a central first translational tray 20 and an upper second translational tray 22. In addition, the racking system 10 includes a variety of dampening members used to control the movement of the first and second translational trays 20, 22 and ensure smooth controlled movement of the first and second translational trays 20, 22 relative to the bracket 18.

The bracket 18 includes a support surface 24 upon which the first translational tray 20 sits when the racking system 10 is fully assembled. A plurality of hooks 26 are secured to the back surface 28 of the bracket 18. The hooks 26 are used to selectively engage a structural support 30 and position the racking system 10 at a desired location.

Extending from the support surface 24 of the bracket 18 are first and second braces 32, 34. The braces 32, 34 extend from opposite sides of the bracket 18, and form a guiding channel in which the first translational tray 20 moves as it linearly moves relative to the bracket 18. Preferably, the first and second braces 32, 34 are L-shaped members which extend upwardly and inwardly toward one another from the support surface 24 to create a guiding channel in which the first translational tray 20 moves.

A first translational bearing track 36 is coupled to the support surface 24 and extends longitudinally toward the forward end 38 of the bracket 18. The first translational bearing track 36 includes a static member 42 rigidly secured to the support surface 24 and telescoping member 40 which telescopically moves along the static member 42. The telescoping member 40 is confined on the static member 42 for controlled movement. The extent to which the telescoping member 40 can be moved along from the static member 42 is limited by stops (not shown) in a conventional manner.

The first translational bearing track 36 and the braces 32, 34 are used in conjunction to control the linear movement of the first translational tray 20 relative to the bracket 18. While the first and second braces 32, 34 form a guiding channel in which the movement of the first translational tray 20 is limited, the first translational bearing track 36 limits the extent of linear movement permitted between the first translation tray 20 and the bracket 18. As such, the first translational tray 20 is coupled to the telescoping member 42 of the first translational bearing track 36. In this way, the linear movement of the first translational tray 20 is limited by the controlled movement of the telescoping member 42 relative to the static member 40.

In addition to limiting the movement of the first translational tray 20 relative to the bracket 18, the movement of the first translational tray 20 relative to the bracket 18 is dampened by magnets 44 secured to the support surface 24 of the bracket 18. The magnets 44 are positioned such that they engage the underside of the first translational tray 20 to dampen the movement of the first translational tray 20 relative to the bracket 18. As such, the magnets 44 run substantially the entire length of the support surface 24 of the bracket 18 to dampen the movement of the first translational tray 20 as it moves relative to the bracket 18. The magnets 44 are strong enough to hold the first translational tray 20 in position relative to the bracket 18 when no force is applied to withdraw the first translational tray 20, but permit movement of the first translational tray 20 relative to the bracket 18 when a user applies the appropriate force.

Additional versatility is provided by the inclusion of a second translational tray 22 supported on the first translational tray 20 for linear and rotational movement relative to both the first translational tray 20 and the bracket 18. Accordingly, the upper surface 46 of the first translational tray 20 is provided with a flat support surface 48 upon which the second translational tray 22 can linearly move. The first translational tray 20 also includes first and second guiding channels 50, 52 formed on opposite sides of the first translational tray 20. The first and second guiding channels 50, 52 are shaped to receive runners 54, 56 of the second translational tray 22, such that the movement of the second translational tray is controlled in a desirable manner.

Accordingly, the second translational tray 22 includes first and second runners 54, 56 shaped and sized to respectively fit within the first and second guiding channels 50, 52 of the first translational tray 20. In use, the first and second runners 54, 56 are telescopically received within the first and second guiding channels 50, 52 such that movement of the second translational tray 22 is controlled by the path defined by the first and second guiding channels 50, 52 of the first translational tray 20.

As stated above, the second translational tray 22 is designed for both linear and rotational movement relative to the first translational tray 20 and the bracket 18. The linear movement of the second translational tray 22 is simply provided by the telescoping movement of the first and second runners 54, 56 within the first and second guiding channels 50, 52. As to the rotational movement of the second translational tray 22 relative to the first translational tray 20, the racking system 10 is provided with first and second mounting brackets 58, 60 employed to couple the second translational tray 22 to the first translational tray 20 in a manner permitting rotational movement.

The first and second mounting brackets 58, 60 are respectively coupled to the rear end 62 of the second translational tray 22 adjacent the first and second runners 54, 56. In fact, the mounting brackets 58, 60 are aligned with the first and second runners 54, 56 such that the mounting brackets 58, 60 are received within the first and second guiding channels 50, 52 when the first and second runners 54, 56 are telescopically received therein. Pivot pins 64, 66 pivotally couple the first and second mounting brackets 58, 60 to the first and second runners 54, 56, respectively, such that the mounting brackets 58, 60 can pivot relative to the second translational tray 22.

When the second translational tray 22 is positioned on the first translational tray 20 for movement relative thereto, the second translational tray 22 will linearly move relative to the first translational tray 20 as the runners 54, 56 telescopically move within the guiding channels 50, 52. When the second translational tray 22 moves toward the forward end 68 of the first translational tray 20, mounting bracket stops 70 on the first and second mounting brackets 58, 60 engage guiding channel stops 72 within the first and second guiding channels 50, 52. The mounting bracket stops 70 and the guiding channel stops 72 engage one another to prevent further forward linear movement of the second translational tray 22 relative to the first translational tray 20.

When the mounting brackets 58, 60 and the second translational tray 22 reach the point at which the forward linear movement of the second translational tray 22 is stopped, the pivotal connections between the second translational tray 22 and the first and second mounting brackets 58, 60 reaches the forward end of the first translational tray 20. At this point, the angled portions 73 at the rear end 62 of the runners 54, 56 are free to move a limited distance within the guiding channels 50, 52. The second translational tray 22 is, therefore, able to rotate a limited distance relative to the first translational tray 20 and the bracket 18. When the second translational tray 22 rotates, the rotational movement is limited by contact between the angled portions 73 of the runners 54, 56 and the inner walls 82, 84 of the guiding channels 50, 52, as well as contact between the runners 54, 56 and the angled portions 75 of the mounting brackets 58, 60.

The rotational and linear movement of the second translational tray 22 is controlled by linear and rotational dampening systems. The dampening systems provide controlled resistance to the movement of the translational tray assembly 19 relative to the bracket 18. Specifically, rotational dampening of the second translational tray 22 relative to the first translational tray 20 is controlled by first and second torsion springs 74, 76 respectively positioned about the first and second pivot pins 64, 66 of the first and second mounting brackets 58, 60. In this way, the first and second torsion springs 74, 76 provide resistance to the downward rotation of the second translational tray 22 relative to the first translational tray 20 as the second translational tray 22 extends beyond the first translational tray 20.

With regard to the linear dampening of the movement of the second translational tray 22, first and second dampening sleeves 78, 80 are respectively provided about the first and second mounting brackets 58, 60. The first and second dampening sleeves 78, 80 are shaped to frictionally engage the inner walls 82, 84 of the first and second guiding channels 50, 52 of the first translational tray 20. Additional dampening is provided by the inclusion of first and second dampening hooks 86, 88. The first and second dampening hooks 86, 88 are secured to the respective rear ends 90, 92 of the first and second mounting brackets 58, 60 by mounting pins 96, 98 such that they frictionally engage the inner walls 82, 84 of the first and second guiding channels 50, 52 of the first translational tray 20.

In use, a container 12 is preferably coupled to the upper surface 94 of the second translational tray 22. The racking system 10 can then be mounted on an appropriate support surface 30. Once the racking system 10 and container 12 are properly supported, the container 12 is easily filled by translating the first and second translational trays 20, 22 to reveal a filling inlet 16 found along a concealed portion of the container 12. When the container 12 is full and the racking system 10 is not being translated, a lock (not shown) can be employed to ensure that the first and second translational trays 20, 22 do not move until such a time that the container 12 must be filled, or otherwise accessed.

Figure 6:
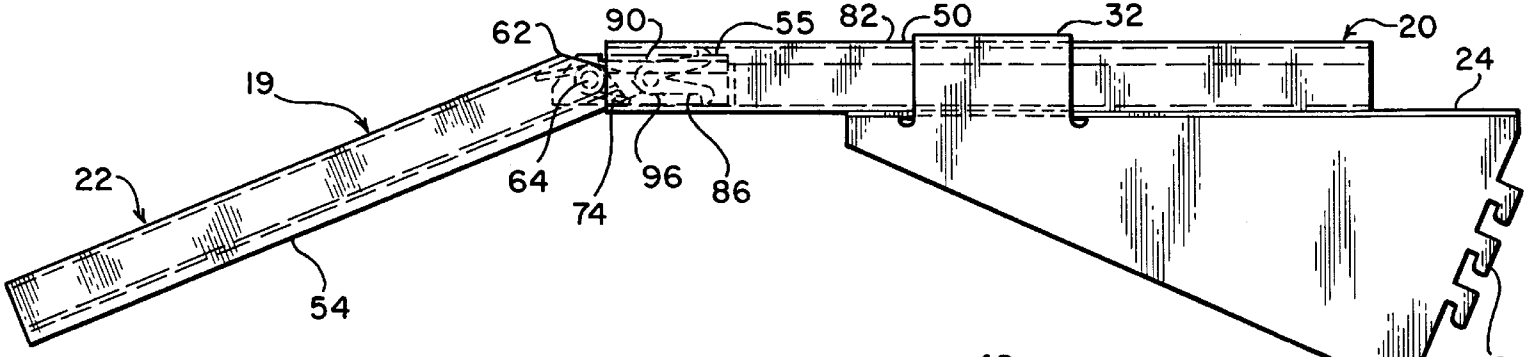
FIG. 6 is a side view showing the second translational tray fully extended such that it can rotate forward.
Figure 7:
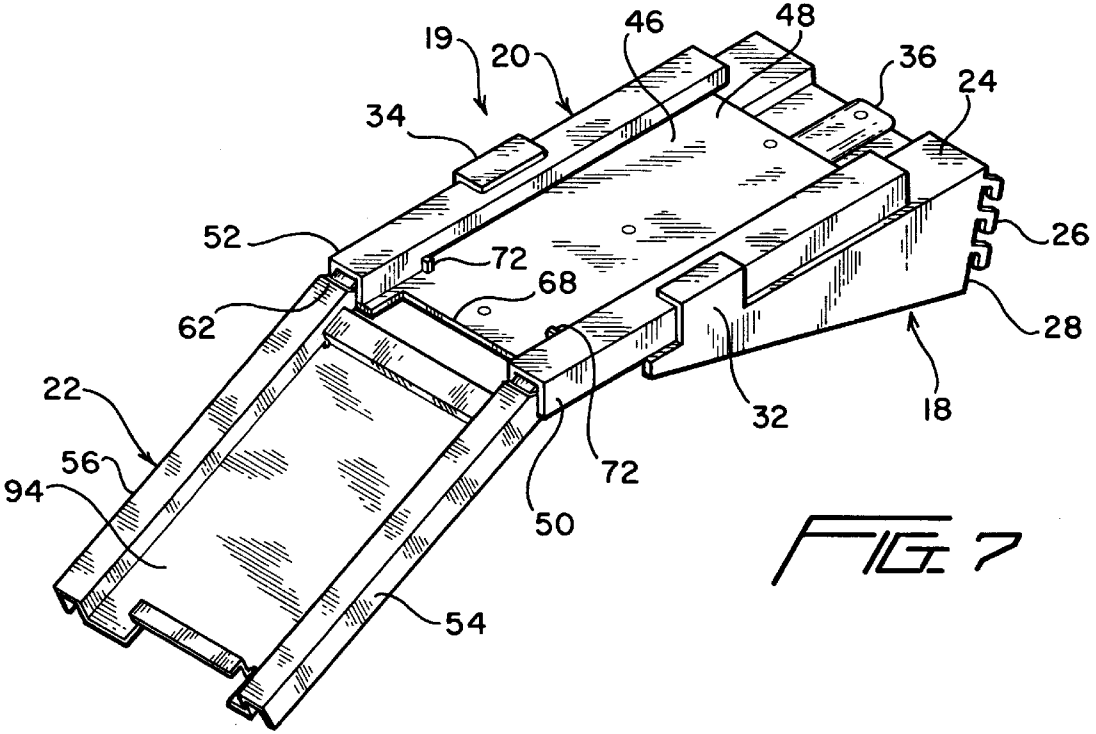
FIG. 7 is a perspective view showing the first and second translational trays fully extended; and, FIG. 8 is a side view showing the motion of the container as it is withdrawn for filling in accordance with the present racking system.
Figure 8:
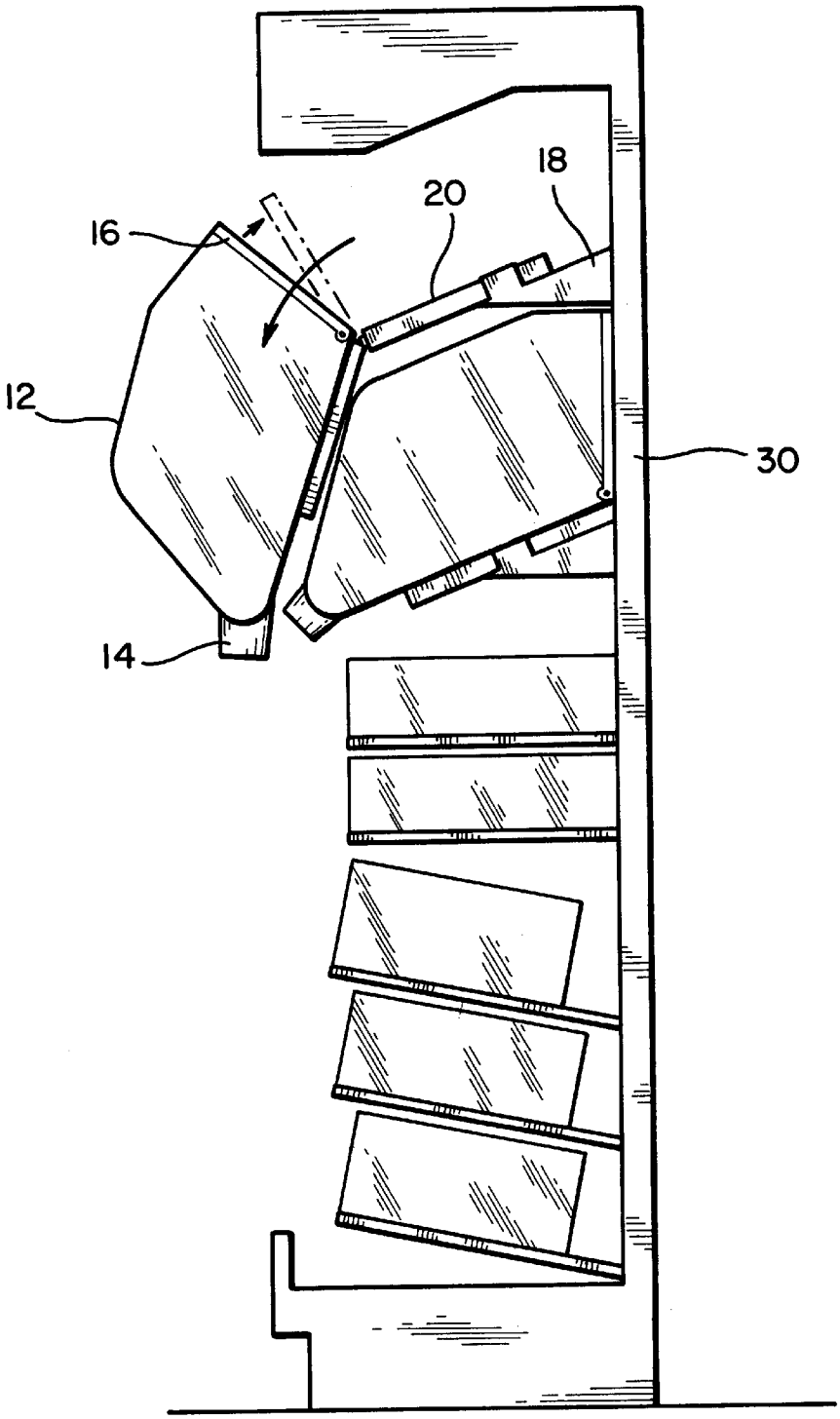

Preferably, as seen in FIGS. 1 and 8, the filling inlet 16 is generally located along a back portion of the container. As such, the filling inlet 16 is concealed when viewed from the front, because the back of the container lies adjacent support surface 30 when the container 12 is fully retracted on the racking system 10. When an individual desires to fill the container 12, he or she simply linearly withdraws the first translational tray 20 relative to the bracket 18, linearly withdraws the second translational tray 22 relative to the first translational tray 20, and permits the second translational tray 22 to rotate downwardly when the second translational tray 22 meets the forward end of the first translational tray 20 (see FIGS. 6 and 7). When the second translational tray 22 is fully withdrawn and rotated downward, the filling inlet 16 in the container 20 is exposed, and an individual may proceed to easily fill the container 12 without having to hold the container. This compound linear and rotational movement permits a vertically concealed filling inlet 16 to be moved to a generally horizontal position for easy filling.

The present racking system has been disclosed with a variety of components for controlling the linear and rotational movement of the translational tray assembly. It should, therefore, be understood that these components can be employed together or separately to suit the needs of a particularly application.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A racking system providing compound movement, comprising:

a bracket adapted for engagement to a structural support;

a translational tray assembly including a first translational tray telescopically connected to a second translational tray, wherein the translational tray assembly is supported by the bracket for linear and rotational movement relative to the bracket;

a first dampening member associated with the translational tray assembly for dampening the linear movement of the translational tray assembly relative to the bracket;

a second dampening member associated with the translational tray assembly for dampening the rotational movement of the translational tray assembly relative to the bracket; and wherein the first and second dampening members ensure controlled motion as the translational tray assembly is rotationally and linearly moved.

2. The racking system according to claim 1, wherein the first dampening member frictionally engages the first translational tray for dampening the linear movement of the second translational tray relative to the bracket and the first translational tray.

3. The racking system according to claim 1, wherein the first translational tray is mounted on the bracket for linear movement relative thereto, and the second translational tray is mounted on the first translational tray for rotational and linear movement relative thereto.

4. The racking system according to claim 1, further including a third dampening member provided between the second translational tray and the first translational tray for dampening the linear movement of the second translational tray relative to the bracket and the first translational tray.

5. The racking system according to claim 1, wherein the second dampening member is a spring positioned between the second translational tray and the first translational tray to control rotational movement between the second translational tray and the bracket.

6. The racking system according to claim 1, further comprising a mounting bracket coupled between the first translational tray and the second translational tray.

7. The racking system according to claim 6, wherein the first translational tray includes a guiding channel and the second translational tray includes a runner received within said guiding channel to ensure controlled linear movement of the second translational tray relative to the first translational tray.

8. The racking system according to claim 7, wherein the mounting bracket is pivotally coupled to the runner of the second translational tray and is received within the guiding channel, such that the second translational tray can not rotate relative to the bracket until the runner moves out of the guiding channel while the mounting bracket remains within the guiding channel to support the second translational tray for rotational movement.

9. The racking system according to claim 7, wherein the second dampening member is a dampening sleeve coupled to the runner of the second translational tray, the dampening sleeve being shaped and dimensioned to frictionally engage an inner wall of the guiding channel.

10. The racking system according to claim 1, wherein the translational tray assembly further comprises a container having an inlet and an outlet and wherein the container is attached to the second translational tray for movement therewith.

11. The racking system according to claim 10, further comprising a plurality of brackets and a plurality of translational tray assemblies, wherein the brackets can be selectively attached to a structural support and wherein the translational tray assemblies are vertically aligned relative to the structural support.

12. The racking system according to claim 1, wherein the first translational tray is telescopically attached to the bracket by a bearing track having a static member attached to the bracket and a telescoping member attached to the first translational tray.

13. A racking system providing controlled linear movement, comprising:

a bracket adapted for engagement to a structural support;

a first translational tray supported by the bracket for linear movement relative to the bracket;

a second translational tray supported by the first translational tray, the second translational tray being supported for linear movement relative to the first translational tray, and wherein a first dampening member is provided between the bracket and first translational tray for dampening the linear movement of the first translational tray relative to the bracket and a second dampening member is provided between the second translational tray and the first translational tray for dampening the linear movement of the second tray relative to the first translational tray, the first dampening member and the second dampening member ensuring controlled motion as the first and second translational trays are moved; and wherein the second dampening member is coupled to the second translational tray and frictionally engages the first translational tray.

14. A racking system providing compound movement, comprising:

a plurality of brackets and a plurality of translational tray assemblies, wherein the brackets can be selectively attached to a structural support and wherein the translational tray assemblies are vertically aligned relative to the structural support;

each of the translational tray assemblies including a first translational tray telescopically connected to a second translational tray, wherein the first translational tray is mounted on the bracket for linear movement relative thereto and the second translational tray is mounted on the first translational tray for rotational and linear movement relative thereto;

wherein each translational tray assembly includes a container having an inlet and an outlet, the container being attached to the second translational tray for movement therewith.

15. The racking system according to claim 14, further comprising:

a mounting bracket coupled between the first translational tray and the second translational tray;

wherein the first translational tray includes a guiding channel and the second translational tray includes a runner received within the guiding channel to ensure controlled linear movement of the first translational tray relative to the second translational tray; and wherein the mounting bracket is pivotally coupled to the runner of the second translational tray and is received within the guiding channel, such that the second translational tray can not rotate relative to the bracket until the runner moves out of the guiding channel while the mounting bracket remains within the guiding channel to support the second translational tray for rotational movement.

16. The racking system according to claim 14, further comprising a first dampening member associated with the first translational tray for dampening the linear movement of the first translational tray relative to the bracket.

17. The racking system of claim 16, further comprising a second dampening member associated with the second translational tray for dampening the rotational movement of the second translational tray relative to the first translational tray.

18. The racking system according to claim 17, further comprising a third dampening member provided between the second translational tray and the first translational tray for dampening the linear movement of the second translational tray relative to the bracket and the first translational tray.

19. The racking system according to claim 13, wherein the first translational tray includes a guiding channel and the second translational tray includes a runner that is received with the guiding channel to ensure controlled linear movement of the second translational relative to the first translational tray and wherein the second dampening member is a dampening sleeve coupled to the runner of the second translational tray, the dampening sleeve being shaped and dimensioned to frictionally engage an inner wall of the guiding channel.

20. The racking system according to claim 19, further comprising a third dampening member provided between the second translational tray and the first translational tray.

* * * * *